US006802727B2

(12) United States Patent
Geilow et al.

(10) Patent No.: US 6,802,727 B2
(45) Date of Patent: Oct. 12, 2004

(54) APPARATUS FOR AND METHOD OF CONNECTING CONNECTORS

(75) Inventors: Gregory Jay Geilow, Eyota, MN (US); Michael Lee Graham, Rochester, MN (US); Lavern Richard Markham, Oronoco, MN (US); Michael Robert Rasmussen, Mazeppa, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/010,976

(22) Filed: Dec. 6, 2001

(65) Prior Publication Data

US 2003/0109156 A1 Jun. 12, 2003

(51) Int. Cl.[7] ..... H01R 13/62
(52) U.S. Cl. ..... 439/160; 439/372; 439/296
(58) Field of Search ..... 439/325, 327, 439/160, 296, 372

(56) References Cited

U.S. PATENT DOCUMENTS 3,767,974 A * 10/1973 Donovan, Jr. et al. ..... 439/160
5,151,041 A * 9/1992 Kaiser et al. ..... 439/157
5,232,375 A * 8/1993 Todd ..... 439/160
5,414,594 A * 5/1995 Hristake ..... 439/325
5,793,614 A * 8/1998 Tollbom ..... 439/160
6,086,385 A * 7/2000 Wang et al. ..... 439/325
6,267,614 B1 * 7/2001 Good et al. ..... 439/160

* cited by examiner

*Primary Examiner*—R. Austin Bradley
*Assistant Examiner*—Briggitte R. Hammond
(74) *Attorney, Agent, or Firm*—Laurence R. Letson

(57) ABSTRACT

This device is advantageous for connecting an electronic circuit card to a test system to inspect the assembled electronic circuit card without damage to the mating connector thereon. A toggle actuated pressing member supports an electrical connector and a flex cable which, in turn, is connected to an electronic device. The pressing member or slide member may be moved toward a mating electrical connector attached to an electronic circuit card, aligned with the connector on the slide member, and forced into a connected condition therewith. The controlled action of the slide block and the connector supported thereon effect connection of the connectors without creating stresses that may damage the electronic circuit card or the connector thereon. A connector supported by the slide block is disconnected by moving the slide block away from the electronic circuit card and, by permitting spring-biased foot blocks to hold the electronic circuit card against movement until after disengagement occurs.

13 Claims, 2 Drawing Sheets

APPARATUS FOR AND METHOD OF CONNECTING CONNECTORS

FIELD OF THE INVENTION

This invention relates to electrical connection equipment and, more specifically, to a device and method for rapid and efficient connection and disconnection of a connector of an electronic circuit card with a connector on a flexible cable.

BACKGROUND OF THE INVENTION

During the manufacture of an electronic circuit card produced in large quantities, the electronic circuit card must be systematically tested to assure proper assembly and operation prior to assembly into an electronic system, such as a computer, server, router, or other similar electronic system.

If the electronic circuit card is connected to the remainder of the host system by a connector, a typical test setup provides a test system with a connector to which the electronic circuit card may be connected.. The system provides electronic signals to operate or "exercise" the electronic circuit card, causing the electronic circuit card to perform all of its functions.

Connecting an electronic circuit card into the test setup typically requires connection of a connector on a cable or other type conductor as a portion of the test setup to a mating connector mounted on the electronic circuit card. In as much as these connectors are manually connectable, manual misalignment is a problem. Such misalignment can result in bent or jammed connector pins causing an electronic circuit card to fail the test or possibly be required to be reworked to replace the connector and retesting, thereby causing significant expense or lost time.

During manual connection or disconnection of the connectors, a twisting force couple may cause electronic circuit card failure. Rough manual handling may result in premature failure of the flex cable of the test setup and necessitate its premature replacement.

While a manual connection and disconnection of the connectors is generally satisfactory for assembly of the electronic circuit card into the host system, the need to accomplish connection and disconnection is infrequent. Great care and sufficient time may be devoted to assure that damage to any component is averted during connection of the electronic circuit cards during final assembly or servicing of the host device. Due to repeated, rapid connection and disconnection of the test setup to the electronic circuit card during testing efficiency and production through put requires a more efficient and comprehensive solution to the problem.

OBJECTS OF THE INVENTION

It is an object of the invention to eliminate damage to connectors and electronic circuit cards resulting from manual connection and disconnection of connectors associated therewith which may occur in the test phase of manufacturing.

It is another object of the invention to reduce wear and tear on flex cables of an electronic test apparatus.

It is an additional object of the invention to connect connectors with consistent and even forces.

It is a further object of the invention to improve efficiency of connections of electronic circuit cards at electronic test stations.

It is a still another object of the invention to disconnect the connectors while maintaining the electronic circuit card in a fixed position.

These Objects of the Invention are exemplary and to identify at least some objectives of the invention. The Objects of the Invention are not intended to nor should they be used in any manner to limit or restrict the invention.

SUMMARY OF THE INVENTION

In order to accomplish the above Objects of the Invention and others which become apparent as well as to overcome the problems of a prior art approach, particularly the manual approach to connecting the connectors, a frame supports a slidable block with a clamping device mounted thereon for retaining an electrical connector in a precise position on an axis of reciprocation and connection, which is aligned with a connector on an electronic circuit card disposed therebelow.

The frame provides a precise reciprocation guide for the slide block as well as a grounding point for a toggle assembly for reciprocating the slide block.

An electrical connector is rigidly clamped to the slide block for connecting the electronic circuit card to an electronic test setup.

Clamping of the electronic circuit card in a position aligned with the connector clamped to the slide block is accomplished by spring-biased electronic circuit card engaging foot blocks pressing on the electronic circuit card. The spring force through the foot blocks is designed to exceed the forces required to disconnect the mating connector on the electronic circuit card from the connector on the flex cable.

An electronic circuit card support provides a solid support surface against which a portion of an electronic circuit card may rest and against which other portions of an electronic circuit card may be forced during the connection process. A central window or opening in the electronic circuit card support prevents contact between the electrical conductors, solder joints and electrical contacts and any other surface. This structure prevents both short circuits during testing and possible breakage of the electronic circuit card or conductors due to deformation of the electronic circuit card or the connections between the circuitry on the electronic circuit card and the connector thereon.

Movement of the slide block, clamp, foot blocks and connector are effected by a toggle mechanism which pushes the slide block or pulls the slide block down or up, respectively. The toggle mechanism may be operated by a manually operable lever or handle. Additionally, a toggle connection may be pushed past dead-center to lock the slide block down against the force of springs biasing the foot blocks, thereby preventing disconnection of the connector and the mating connector during the testing of the electronics of the electronic circuit board. Movement of the slide block forces the aligned connectors together completing the connection thereof.

The toggle may be unlocked by pulling the toggle connection back over-center and either pulling the slide block away from the electronic circuit card or by permitting the spring-bias to separate the slide block and connector from the mating connector on the electronic circuit card.

This Summary of the Invention is provided as a brief description of the more significant aspects of the invention to aid the reader in gaining a general understanding of the invention and is not intended to be used to limit the invention in any manner.

A more complete and detailed understanding of the invention may be gained from the attached drawings and the Detailed Description of the Invention that follow.

DETAILED DESCRIPTION OF A PREFERRED EMBODIMENT

OF THE BEST MODE FOR IMPLEMENTING THE INVENTION AS CONTEMPLATED BY THE INVENTORS

Figure 1:
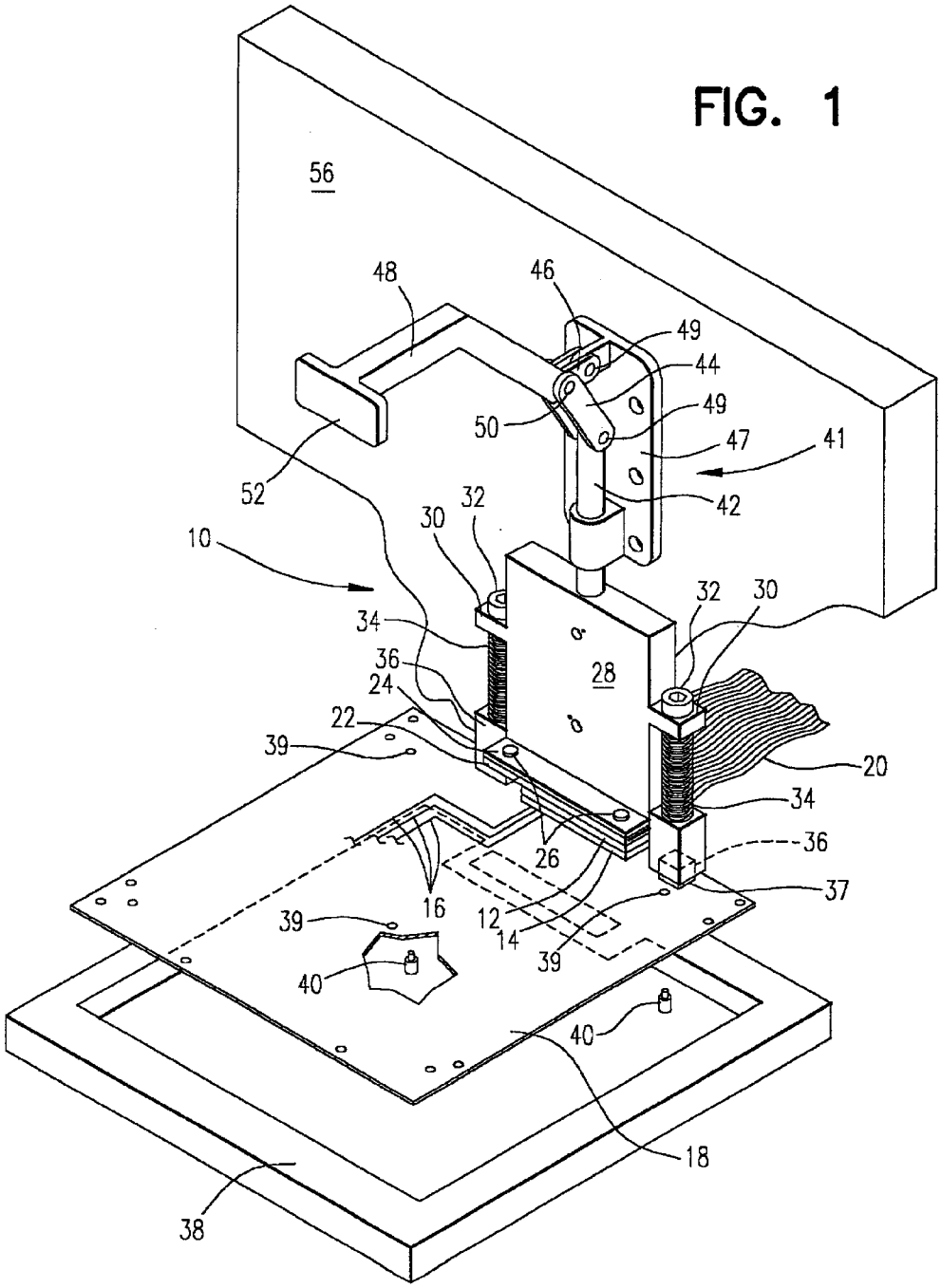
FIG. 1 is an isometric illustration of the connector connection tool of the invention.

A connector connecting device 10 is illustrated in FIG. 1. The device 10 is useful both for reliably connecting and disconnecting a cable connector 12 to and from a mating connector 14 and also eliminating undesirable forces which may cause failure of the electronic circuit card, cable or cable connector 12.

For purposes of illustration, the mating connector 14 is fixedly attached to electrical conductor lands 16 which are incorporated into an electronic circuit card 18. An electronic circuit card 18 is illustrated in a largely unpopulated form for simplicity and ease of focusing on the invention. Electronic circuit cards are common and their design and fabrication is well-known and within the skill of the art.

The invention may be used with virtually any electronic circuit card 18 which must be connected by a flex cable, particularly, for testing. It is customary and prudent to fully test an electronic circuit card 18 prior to installation in the host device to insure its operability following assembly. In order to perform such tests, a test system is assembled excluding the electronic circuit card 18. The electronic circuit cards 18 to be tested are connected to the test system completing the system, and a series of electronic operations are performed to verify the operability of the electronic circuit card 18.

A mating connector 14 is typically soldered onto an electronic circuit card 18 during assembly of an electronic circuit card 18 with the electrically conductive lands 16 solder connected to the pins, contacts or sockets (not shown) of the mating connector 14. Whenever finally assembled in the host device, typically a computer, server, router or other electronic device, the mating connector 14 is further connected to a connector (not shown) installed on the end of a multi-conductor flexible cable (not shown), the other end of which is connected to electrical connections in the host device.

The connector 12 on flex cable 20 is connected to mating connector 14 to complete the test setup and accomplish the desired testing. Clamp 22 is provided and supported by flange 24 in order to prevent misaligned or unbalanced forced engagement of connector 12 with mating connector 14, and thereby to prevent damage from manual connection and disconnection of the connector 12 and mating connector 14. Clamp 22 is fashioned to hold at least a portion of connector 12 against flange 24. The clamp 22 and flange 24 may be connected to each other to provide the clamping relationship and clamping forces by common machine screws, bolts or other conventional fasteners (not shown) extending into holes 26.

Flange 24 is a part of, attached to, or supported by slide block 28. Thus, flange 24 and clamp 22 move with slide block 28. The connector 12 is attached to flange 24 by fasteners 26.

Slide block 28 further has a part thereof or attached thereto at least one and, preferably a pair of mounting lugs 30. Mounting lugs 30 and bolts 32 combined constitute guides for the bolt 32. Mounting lugs 30 each support an assembly of a bolt 32, a coil compression spring 34, and a foot block 36. The bolt 32 extends through mounting lugs 30 and may translate therethrough. Bolt 32 is surrounded by spring 34 and is threaded into or otherwise attached to foot block 36 and tightened to pre-stress the spring 34 to a level that the combined compression pre-stress of multiple springs 34 exceeds the force necessary to overcome the frictional disengagement forces necessary to disconnect the connector 12 and mating connector 14.

Alternatively, the pre-stress loading of springs 34 plus the compression loading of spring compression during connection of connector 12 and mating connector 14 exceeds the forces required for disconnection of connector 12 from mating connector 14 at all stages of compression.

Holding member or foot block 36 not only co-operates with bolt 32 to confine ring 34 in its pre-stressed or pre-loaded condition but also serves to engage electronic circuit 18 to trap and clamp electronic circuit card 18 in the desired location relative to the electronic circuit card support 38 or base member 38 and locating pins 40. Locating pins 40 are positioned on the electronic circuit card support 38 and mate with holes 39 in the electronic circuit card 18 to assure that the mating connector 14 is accurately positioned below connector 12. The electronic circuit card support is formed to provide a solid support for the edges of electronic circuit card 18 and the area surrounding the mating connector with relief in the region where electronic components are soldered to the electronic circuit card 18.

In order to clamp the electronic circuit card 18 onto electronic circuit card support 38, the foot blocks 36 are lowered by lowering slide block 28, thus engaging foot block 36 with the electronic circuit card 18. Continued downward movement of slide block 28 will compress springs 34, thereby progressively increasing force of foot blocks 36 upon the electronic circuit card 18.

Simultaneously, with the continued downward movement of slide block 28, the clamped connector 12 is moved into engagement with mating connector 14 and the mating of the connector 12 and the mating connector 14 is accomplished.

Movement of slide block 28 is effected and controlled by an actuating or assembly toggle assembly 41. Toggle assembly 41 is comprised of a thrust shaft 42 extending from slide block 28, pivotally connected to a toggle link 44, and extending through toggle link 44 to toggle arm 46. Extending from toggle arm 46 and a part thereof is a toggle lever 48. The toggle arm 46 and toggle link 44 are articulated by a toggle joint 50 or toggle pin 50. The toggle assembly 41 is further preferably articulated at one end to a toggle support bracket 47 which, in turn, is fixedly attached to a supporting frame 56.

Thrust shaft 42 should be dimensioned such that a full over-center stroke of toggle arm 46 will push the toggle pin 50 past the center line of the pins 49 connecting the toggle link 44 to the thrust shaft 42 and toggle arm 46 to toggle support 47 attached to the frame 56. Such positioning of these elements 44, 46, 50 locks slide block 28 in its displaced position prior to the slide block 28 reaching a displacement which will forcibly jam connector 12 against mating connector 14 after connector 12 and mating connector 14 are fully engaged and fully connected, thereby preventing any undue stress to the electronic circuit card 18 and the structures of the connector 12 or the mating connector 14.

While illustrated as a manually operated mechanism, toggle assembly 41 may be adapted for actuation and movement by hydraulic or pneumatic actuators if desired. Such operation may be particularly advantageous if the device is used in conjunction with a robotic placement device or is not disposed within easy reach of the operator.

If hydraulic or pneumatic actuators (not shown) are used to control toggle assembly 41, a frame may serve as a grounding member therefore. Alternatively, a direct connection to the thrust shaft 42 may be used to transfer motion from a hydraulic/pneumatic actuator to the slide block 28.

The foot block 36 may be fashioned with a reduced or small area foot surface 37 to engage 264 a small or reduced area on the electronic circuit card 18 surface, thereby concentrating the holding force onto a small unpopulated region of the electronic circuit card 18. A small engagement area avoids damage to any of the circuit lands or electronic components with which an electronic circuit card is normally populated.

Another distinct advantage of the invention is that forces effecting both connection and disconnection of connector 12 and mating connector 14 are balanced about the connectors 12, 14, thus eliminating twisting and bending of the electronic circuit card 18 which may cause failure of an electronic circuit card 18 during the testing procedure.

The slide block 28 may be fabricated with a guide channel 62; and additionally, the frame 56 may be formed to provide or support a guide structure 60 to provide repeatable displacement of the slide block 28 relative to the mating connector 14.

Figure 2:
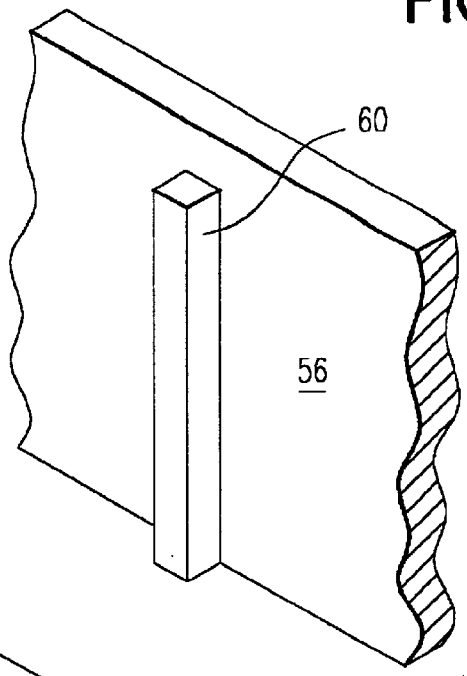
FIG. 2 is an isometric illustration of a frame structure with a guide structure.
Figure 3:
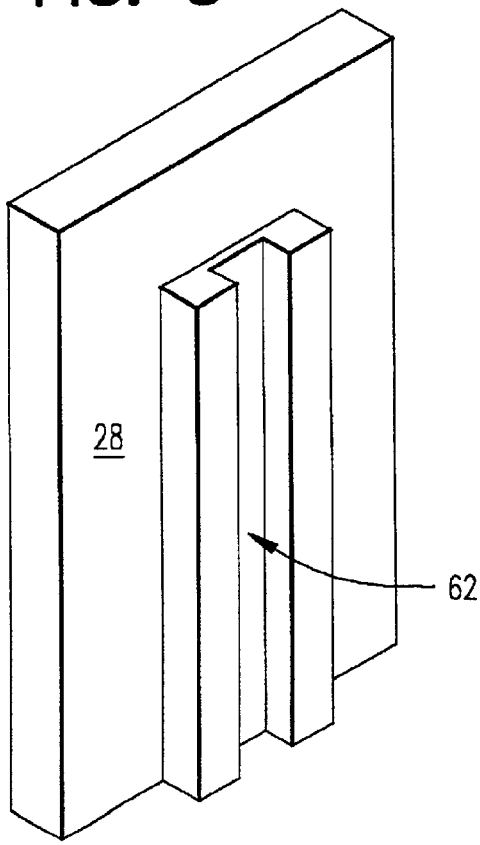
FIG. 3 is a rear isometric illustration of a slide block with a guide channel.

While the guide structure 60 is illustrated in FIG. 2 and the guide channel 62 is illustrated in FIG. 3, any of a number of conventional and commercially available slide apparatuses may be used.

Operation of the invention is simple and requires only the placement of an electronic circuit card 18 on the electronic circuit card support 38, locating pins 40 inserted into locator holes 39, and a downward movement of the toggle lever handle 52. This movement of the toggle lever handle 52 straightens toggle mechanism 41 and forces the movement of slide block 28 downward to connect connector 12 with mating connector 14. Reversing the movement of toggle handle 52 and unlocking the toggle mechanism or assembly 41 will disconnect connector 12 from mating connector 14 by the foot blocks 36 retaining electronic circuit card 18 against the electronic circuit card support 38 and the springs providing the separating force.

This Detailed Description of the Invention is provided to teach one of ordinary skill in the art an understanding of the invention and is not intended to limit the invention in any manner. It should be further understood that various minor changes and modifications to the disclosed apparatus may be made by one of skill in the art without departing from the scope of the invention as defined by the attached claims.

We claim:

1. A connecting apparatus for connecting a connector on an electronic circuit card, and a mating connecting device comprising:

an electronic circuit card support, said electronic circuit card support comprising locating pins engageable with said electronic circuit card for positioning said electronic circuit card relative to said connecting device, said electronic circuit card support comprises a support disposed in a region of said electronic circuit card comprising electrical conductors electrically associated with said mating connector;

a frame fixedly disposed relative to said electronic circuit card support;

a movable member disposed for confined movement toward and away from said electronic circuit card support;

said frame comprises a guide engaged with said moveable member confining said movement to a toward and away motion relative to said electronic circuit card support;

said moveable member carrying at least one biasing spring and at least one engaging member biased by said spring toward said electronic circuit card support and away from said movable member and further displaceable against said spring-bias and translatable relative to said movable member;

said movable member further comprising a clamp for holding and translating said connector with said movable member, an actuating assembly comprising a toggle actuating manually operable handle;

whereby acruation of said actuating assembly and said manually operable handle displaces said moveable member relative to said frame, and said connector relative to said mating connector device and connectingly mates said connector and said mating connector device.

2. The connecting apparatus of claim 1 wherein said guide comprises at least two parts, one of said parts constrained for only reciprocal, linear movement relative to the other of said parts.

3. The connecting apparatus of claim 1 wherein said clamp comprises a base member and a holding member and said holding member is restrained relative to said base member by fasteners.

4. The connecting apparatus of claim 1 wherein said engaging member comprises a surface disposable for engagement with one surface of said electronic circuit card and forcing said electronic circuit card toward said electronic circuit card support.

5. The connecting apparatus of claim 4 wherein said spring exerts force through said engaging member on said electronic circuit card in excess of any force exerted on said connector by said connecting device to disconnect said connector from said connecting device.

6. A method of connecting a connector to a mating connector an electronic circuit card comprising:

providing an apparatus comprising a frame, an electronic circuit card support, a moveable member displaceable relative to said frame and confined for movement only toward and away from said electronic circuit card support, said moveable member supporting a clamp and said connector and at least one spring exerting a spring-bias on an engaging member, said engaging member disposable for engagement with said electronic circuit card and an electronic connector retained within said clamp, said movable member connected to a toggle assembly;

positioning said movable member, said clamp, said connector disposed within said clamp and said spring-biased engaging member displaced from said electronic circuit support;

disposing an electronic circuit card and a mating connector aligned with said connector within said clamp;

displacing said moveable member toward said electronic circuit card support said against said spring-bias, thereby trapping said electronic circuit card against said electronic circuit card support, and further displacing said movable member, said clamp and said connector into a connected position, thereby mating end connecting said connector with said mating connector.

7. The method of connecting a connector to a mating connector on an electronic circuit card of claim 6 comprising an additional step of locking said movable member in said connected position.

8. The method of connecting a connector to a mating connector on an electronic circuit card of claim 7 wherein said locking step comprises displacing a toggle joint in a position whereby force of said spring-bias on said toggle joint is prevented from disconnecting said connector and said mating connector.

9. A method of connecting and disconnecting a connector to a mating connector on an electronic circuit card comprising:

providing an apparatus comprising a frame, an electronic circuit card support, a movable member displaceable relative to said frame and confined for movement only toward and away from said electronic circuit card support, said moveable member supporting a clamp and said connector held by said clamp and at least one spring exerting a spring-bias on an engaging member, said engaging member disposed for engagement with said electronic circuit card and an electronic connector retained within said clamp, said moveable member connected to a toggle assembly;

positioning said movable member, said clamp, said connector and said spring-biased engaging member displaced from said electronic circuit card support;

disposing an electronic circuit card and a mating connector aligned with said connector held by said clamp;

displacing said moveable member toward said electronic circuit card support and against said spring-bias, thereby trapping said electronic circuit card against said electronic circuit card support, further displacing said movable member, said clamp, said connector into a connected position connecting said connector with said mating connector, thereafter, displacing said movable member away from said electronic circuit card and said electronic circuit card support, responsive to forces provided at least in part by said spring;

separating said connector and said mating connector;

further permitting extension of said spring; and withdrawing said movable member away from said electronic circuit card.

10. The method of connecting and disconnecting a connector to a mating connector on an electronic circuit card of claim 9 comprising an additional step of locking said movable member in said connected position.

11. The method of connecting and disconnecting a connector to a mating connector on an electronic circuit card of claim 10 comprising the further step a displacing said toggle assembly to a position locking said movable member, preventing movement of said movable member under the influence of said spring-bias, and a subsequent step (displacing said toggle assembly to a position unlocking said movable member permitting movement of said movable member under at least a force partially provided by said spring-bias.

12. The method of connecting and disconnecting a connector to mating connector on an electronic circuit card of claim 10 wherein said locking step comprises displacing a toggle joint in a position whereby force of said spring-bias on said toggle joint is prevented from disconnecting said connector and said mating connector.

13. The method of connecting and disconnecting a connector to mating connector on an electronic circuit card of claim 12 comprising the further step of displacing said toggle assembly to a position locking said movable member, preventing movement of said movable member under the influence of said spring-bias, and a subsequent step of displacing said toggle assembly to a position unlocking said movable member permitting movement of said movable member under at least a force partially provided by said spring-bias.

* * * * *